United States Patent [19]

Prevedini

[11] 4,442,646

[45] Apr. 17, 1984

[54] DEVICE FOR ANCHORING TENSIONING ELEMENTS

[75] Inventor: Cesare Prevedini, Milan, Italy

[73] Assignee: Ponteggi Est S.p.A., Italy

[21] Appl. No.: 512,949

[22] Filed: Jul. 13, 1983

Related U.S. Application Data

[63] Continuation of Ser. No. 201,570, Oct. 28, 1980, abandoned.

[51] Int. Cl.[3] ..... E04C 5/12

[52] U.S. Cl. ..... 52/230

[58] Field of Search ..... 52/223 R, 223 L, 230, 52/309.3

[56] References Cited

U.S. PATENT DOCUMENTS

| | | | |
|---|---|---|---|
| 2,371,882 | 3/1945 | Freyssinet | 52/230 |
| 2,934,935 | 5/1960 | Zerna | 52/223 L |
| 3,212,222 | 10/1965 | Wittfoht | 52/230 |
| 3,307,310 | 3/1967 | Kourkene | 52/230 |

FOREIGN PATENT DOCUMENTS

| | | |
|---|---|---|
| 1328971 | 4/1963 | France . |
| 1379706 | 10/1964 | France . |
| 1551829 | 11/1968 | France . |
| 1585762 | 1/1969 | France . |
| 2118861 | 4/1972 | France . |

*Primary Examiner*—John E. Murtagh

*Attorney, Agent, or Firm*—Bacon & Thomas

[57] ABSTRACT

Device for anchoring tensioning elements, such as strands, bundles of metal strands or cables with metal or concrete structures, comprising one or more tensioning elements, a plate for load distribution, the plate being perforated for the passage of said tensioning elements, and clamping means for each of the tensioning elements, according to which there are further provided: a box for receiving all said tensioning elements so as not to contact the box walls, the box being provided with opposite openings of a sufficient size to allow the passage of said tensioning elements; a plurality of tubes of sufficient inner size to accommodate with clearance each of the tensioning elements; a packing of epoxy resin in said tubes and said box about said tensioning elements. Provision is also made for adjustment of the strain by means of a ring nut, as well as interchangeability of the tensioning elements.

2 Claims, 6 Drawing Figures

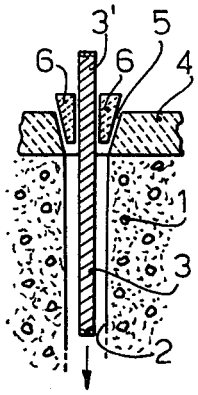
FIG.1 PRIOR ART
PRIOR ART FIG.2
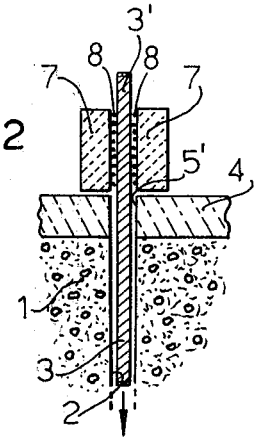
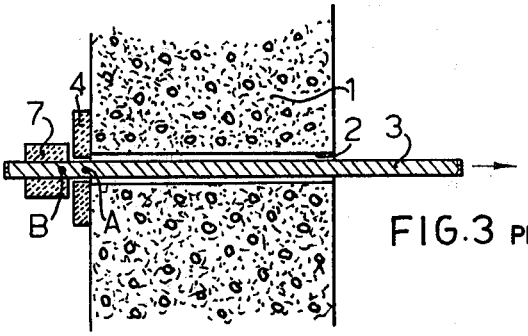
FIG.3 PRIOR ART
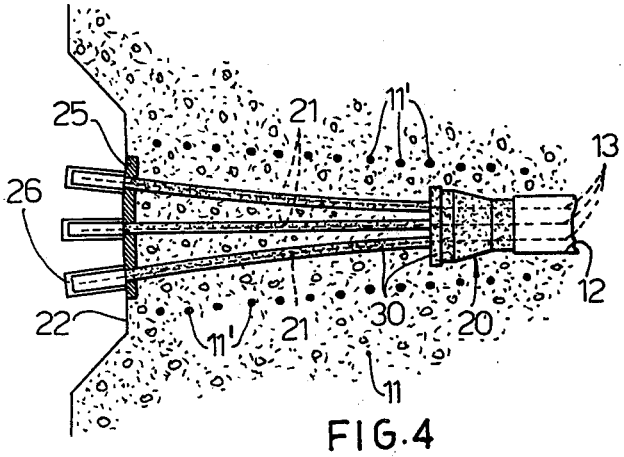
FIG.4
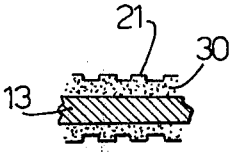
FIG.5

DEVICE FOR ANCHORING TENSIONING ELEMENTS

This is a continuation of application Ser. No. 201,570, filed Oct. 28, 1980, now abandoned.

This application relates to anchoring systems for tensioning elements, such as strands, bundles of metal strands or cables with metal concrete structures or the like, as in works of civil engineering, for example precompressed reinforced concrete structures, structure anchoring stayings, windbracings, etc.

The prior art anchoring systems between tensioning elements and concrete structures are in most cases friction systems; a first type of anchoring system uses metal wedges blocking any slipping between one or more strands and an anchoring plate; in a second system metal rings are forced about the strand head (in case with the interposition of elements such as springs, coils, etc.) so that such a ring and strand will "seize" and no more relative slippings will occur after forcing.

These systems are widely applied to anchoring heads of strands as used in sliding wire precompression cables in precompressed reinforced concrete works of civil engineering. In these applications the tension in the strand (and accordingly in the anchorage) undergoes very moderate changes, after the strand has been initially put under tension and cement mortar (or the like) has been injected into the sheath separating the strand from the concrete structure throughout its length between the two heads. However, in some particular applications of civil engineering this strain or stress condition of the anchorage is considerably different: the initial tension of the strand is relatively moderate, while the strand and anchorage are subjected to remarkable changes in strain, after the strand-concrete clamping has been carried out by one of the above described friction systems. Examples of these applications are: stays of bridge girders, tensiostructures, metal wire bracings for towers, antennas or the like with ground anchored stayings.

In all of these applications, the above defined tensioning element, for brevity hereinafter merely referred to as "strand", is free, that is not adhering to the concrete (or other structures) along the development thereof. The changes in tension therein caused by changes in loads (wind, casual variable factors) are transmitted as such to the anchorage. Unavoidably, there is a location close to the anchorage where the change in strain is the same as that of the free strand, and a further location very close to said first mentioned location, but at the anchorage area, where the changes in strain are much more complex, due to the simultaneous provision of high strains orthogonal to the strand axis, shearing stresses, and strain concentrations at the contact locations between strand and anchorage.

Therefore, at this area the fatigue phenomena, more than those of high load strength, are the phenomena leading to strand failure or breakage, as well known in ordinary construction practice and as supported by experimental researches. In the known technique, this would lead to oversize the strand sections in the applications above referred to: not for strength purpose to extreme loads, but in order to attempt to reduce the changes in strain at the anchorage areas, the magnitude of which highly affects the number of load cycles leading to strand failure or breakage.

Therefore, it is the object of the present invention to provide strand anchoring systems, other than those used in standard precompressed reinforced concrete works, having the following qualifications:

(a) from a mechanical standpoint, an anchorage distributed along a rather large extension of the strand, so that strain concentrations are avoided and fatigue phenomena are reduced, while uusing a reduced amount of epoxy resin;

(b) from an economical standpoint, easy installation with operations of the same type as those carried out for anchorages of standard precompressed reinforced concrete (strand prestressing, clamping, injection);

(c) possibly removable, that is the whole anchorage can be readily separated from the main structure, even several years after the construction, and accordingly replaced with a new anchorage; and (d) preferably adjustable, that is the capability of varying the mutual distance or spacing between the anchoring plate and main structure, after installation of the anchorage, for following constructive requirements.

The qualifications according to (a) and (b) have been achieved by an anchoring device comprising:

(1) a load distributing plate bearing on the main structure of reinforced concrete (or metal) and distributing the concentrated loads from the anchorage of the individual strands;

(2) a box accomodating all of said strands. This box is of varying size depending on the number of strands, but in any case should be of a shape not allowing relative slippings between said box and concrete. This is achieved by preferably shaping the box in a frusto-conical or truncated pyramid shape, and/or corrugating the surface thereof. This box is the location where minor are the transverse dimensions of the anchorage. Therefore, it is advisable to provide for the adjusting device, where required, at said box. This is achieved by providing a screw thread about the box filled up with resins, which screw thread has applied thereto a ring nut transferring the loads to the main structure;

(3) a system of tubes extending between said plate referred to at (1) and said box referred to at (2), which tubes may or not may be of metal, internally and externally corrugated and of varying length. At some sections of the inner wall of the tubes there may be a film of Teflon or similar antifriction material; thus, the strand should be allowed to slide in the sections of larger curvature of the tube and towards the box. According to a first embodiment, these tubes and box may be embedded in the concrete casting constituting the main structure to which the strand system is to be anchored. This first embodiment is suitable only for fixed anchorages. In order to provide an adjustable type of anchorage, the tubes are made integral by means of resins with a block, preferably made of concrete, fully independent of the main structure, and accordingly forming a kinematically unitary piece or body with the anchoring plate and box. In order to reduce the size of this block, use is preferably made of very high strength concrete, that is one having a compressive breaking stress higher than 1,000 kg/sq.cm.;

(4) a conventional clamping system between the strands and plate for load distribution; it may comprise standard metal ring cones and/or ring systems seized to the strand; and (5) an injection of epoxy resin fully filling up the spaces or gaps between each strand and inner walls of the tubes, and also completely filling up said box referred to at (2).

It is also an object of the present application a process for the installation of anchorages between a strand or bundle of strands and a reinforced concrete structure, the process comprising the following steps:

(I) Preassembling of the following elements or parts: load distributing plate, box and tubes extending between said plate and box. In one case (fixed anchorage) these tubes will then be enclosed or surrounded by the concrete of the main structure. In another case (adjustable anchorage) the tubes are integral with a block, preferably made of high strength prefabricated concrete, which is installed together with said plate and box.

(II) Concrete casting of the main structure and curing thereof.

(III) Possible threading of the strands (if not carried out at the first step) and pretensioning thereof at the level required by the structural problem.

(IV) Injection of epoxy resin in the tubes and metal box.

(V) Subsequent adjustment, if desired, (even after years) of the length and tension of the strand assembly, by the following operations:

application of a jack to the whole installation assembly (plate, prefabricated block, tubes and box injected with resins) slightly separating said block from the main structure; and screwing of the ring nut to the desired new position, possibly with the interposition of metal spacers.

(VI) Possible replacement of the tensioning element: without breaking the main structure, particularly of concrete, the tensioning elements are cut, so that the entire installation assembly comprising the load distributing plate, tubes and box can be removed and replaced with a new assembly.

With an assembly and anchoring process according to the present application, anchorages are provided between strands and structures, in which an improved load condition is obtained in the strand (avoiding strain concentrations and reducing the fatigue phenomena); the strength characteristics of the materials are better taken advantage of with respect to the anchorages of the prior art; and accordingly the total carrying section of the strands can be reduced for a same stress; moreover, the process can be easily carried out and does not require any particular skill.

The description is given hereinafter for some embodiments of the anchorages according to the prior art and as presently used, and further embodiments of anchorages according to the present application, with reference to the figures of the accompaanying drawings, in which:

FIGS. 1 and 2 respectively show typical conventional anchorages between a strand head and a concrete structure, wherein the latter is shown in a sectional view;

FIG. 3 is a view schematically showing a stay anchorage;

FIG. 4 is a sectional view showing a novel anchoring assembly between a bundle of strands and a concrete structure according to a first embodiment of the present invention;

FIG. 5 is an enlarged broken away axial sectional view showing a detail of a tube of the anchoring assembly shown in FIG. 4.

Figure 6:
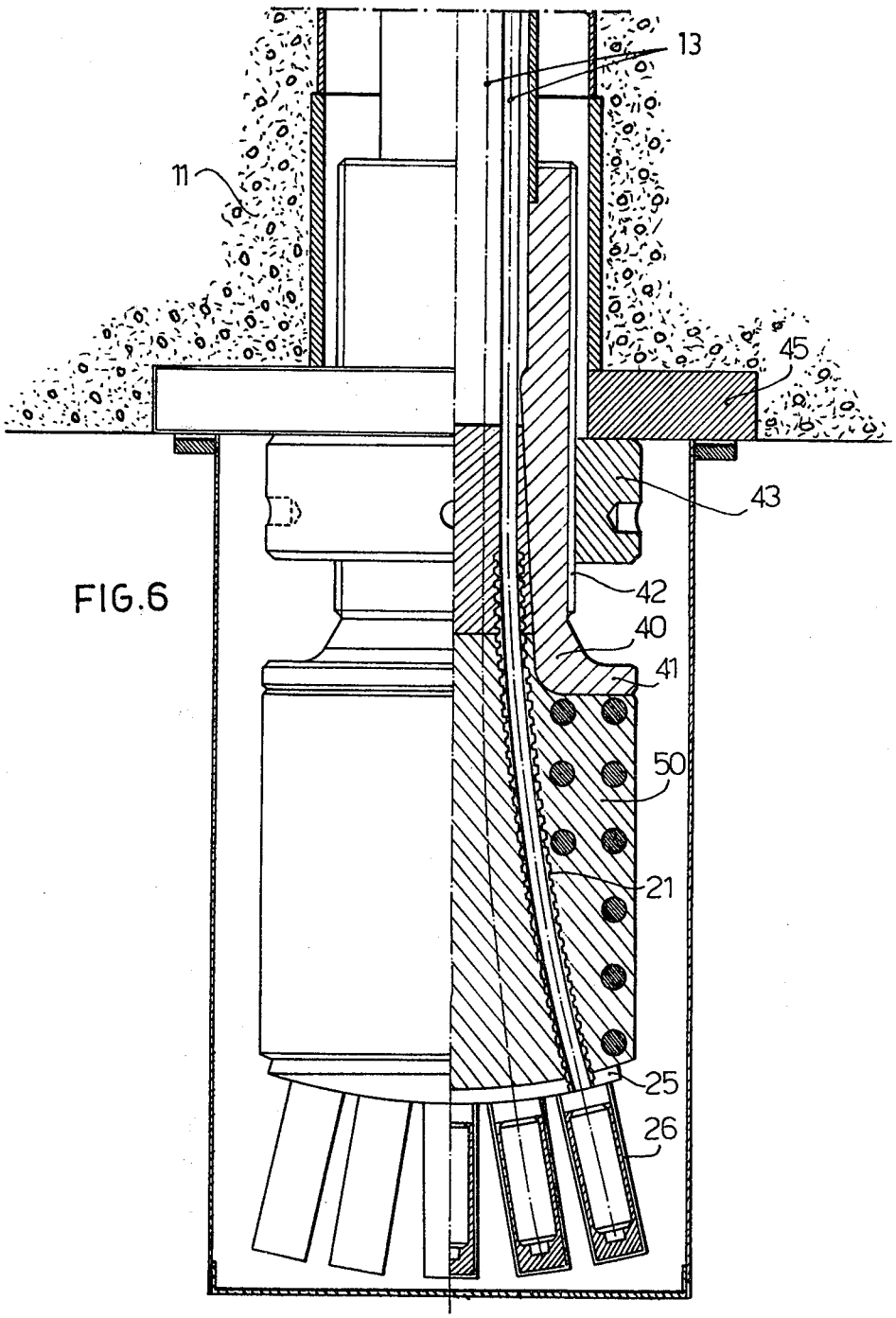
FIG. 6 is a sectional view showing a second embodiment which is of both adjustable and removable type.

FIG. 1 shows a concrete structure 1 having a sheath 2 for the passage of strand 3 therethrough. The latter is accomodated with clearance within said sheath 2 and anchored to said structure 1 by a load distributing plate 4 shaped with a countersunk or flared hole 5. Three or more wedge elements 6 are arranged about the head 3' of said strand 3 hand have the surfaces facing said strand suitable not to slide thereon. When the strand has applied thereto an axial force outline by the arrow shown in FIG. 1, said wedge elements 6 move near one another by contact with the walls of hole 5 and clamp said strand 3 therebetween.

In the example shown in FIG. 2, reference numeral 1 still designates the concrete structure and reference numeral 3 designates the strand as freely accommodated within said sheath 2.

The load distributing plate 4 has a hole 5' for the passage of the strand head 3' and about said strand head a metal ring 7 is forced with the interposition of a spring 8 between said ring and strand.

With reference to FIG. 3 (in which the same reference numerals of FIG. 2 have been used) an explanation will now be given as to the disadvantages which may arise with such types of the above anchorages when used in structures, such as stayings, tensiostructures, braces, etc., in which the strand and anchorage are subjected to considerable change in strain.

The strand (or in other cases the bundle of strands) is/are free, that is to say not adherent to the concrete in its length. When considering a point or location A in the strand (FIG. 3) very close to the anchorage, the change in strain at A is equal to the change in strain in the free strand. At a point or location B very close to A, but in the anchorage area, the changes in strain are very complex, as above mentioned, due to the simultaneous presence of high strains orthogonal to the strand axis, shearing stresses and strain concentrations at the contact location between said strand and anchorage.

A first embodiment of an anchorage according to the present invention is shown in FIGS. 4 and 5. In a concrete structure 11, in which an only exemplary reinforcement 11' is shown, a sheat 12 freely receives a bundle of strands shown by broken line and carrying the reference numeral 13.

Adjacent the anchoring end or head for said strands 13, the concrete structure incorporates a box-like element, designated as a whole at 20, which has open or perforated opposite bases and is of sufficient inner size for the passage of said strands 13 without any contact with the walls, and further has an outer configuration for preventing the box from sliding relative to the concrete. In the figure of the drawing, said box 20 has a substantially frustoconical or truncated pyramid shape; other boxes could be cylindrical, but have a corrugated surface. In this embodiment, said box 20 is generally made of metal sheet.

The concrete structure further incorporates a bundle of tube-like elements 21, generally but not necessarily one for each strand, arranged between said box 20 and the concrete surface 22. Each of said tubes 21 have an inner diameter slightly larger than the diameter of strand 13 and have a corrugated surface, as best shown in FIG. 5, such a corrugation of the surface being at the outside in order to promote adherence to the concrete and at the inside in order to promote adherence to a packing with epoxy resins, as hereinafter explained.

The novel anchorage also comprises a load distributing plate 25, conventionally perforated to receive the ends of strands 13 exiting from said tubes 21, which ends are clamped to the plate in any known manner or by any conventional means, such as those shown in FIGS. 1 and 2. Such means have not been shown in detail and are designated by reference numeral 26. The novel anchorage further comprises a packing of epoxy resin, generally carried out by injection and shown at 30, about the strands in said tubes and box. Particularly, the shape taken by the resin on filling up the prearranged free spaces or gaps is such that a larger mass of resin exists at the side where the strands gather and then proceed at free state (that is in the box), whereas the resin volume is more finely distributed about the strand at the side where the strands join the anchoring plate (tubes).

The epoxy resins used for injection are of the type at present commercially available, and having the following characteristics:

hardening without any need of outside heating, but by addition of catalyst;

sufficient flowability to penetrate into interstices 1 mm thick;

coefficient of tensile elasticity (after hardening) ranging between 20,000 and 100,000 kg/sq.cm. and coefficient of compression elasticity ranging between 25,000 and 150,000 kg/sq.cm.;

tensile strength higher than 200 kg/sq.cm.;

compressive strength higher than 500 kg/sq.cm.;

shearing strength higher than 100 kg/sq.cm.; and the resins may be added with siliceous or metal inert materials in order to graduate the elasticity and strength thereof.

According to a varient to this embodiment, a coating or lining of antifriction material has been provided on the inner face of the tubes at the sections of major curvature thereof, so as to allow a good slipping for the strand in case of contact.

The above described device or assembly for the anchorage of a bundle of strands could also be used for anchorage of a cable.

Where a cable has to be anchored to a concrete structure, the cable distribution of the various strands or wires comprising it is carried out within the box (for example, the box 20 of FIG. 4). The individual separated strands or wires then proceed in the tubes, such as 21 in FIG. 4, to reach the anchorages 26, just as shown and described in FIG. 4.

The novel anchorage is carried out by preassembling said box 20 with said tubes 21 and plate 25 and placing the assembly together with the reinforcement 11' in the caisson intended to receive said concrete structure 1. The concrete is then cast and cured. The strands may be threaded into the box and tubes at the preassembling step, or after casting and curing of the concrete In case, the required pretension may be applied thereto.

Then, the epoxy resin is injected by per se well known techniques to fill up the spaces or gaps within said tubes 21 and box 20.

In the novel anchorage shown in FIGS. 4 and 5, the clamping means (such as wedges, ring, etc.) 26 transmit to the metal plate 25 (and the latter to concrete) the whole amount of initial pretension to which the strands are subjected. They also transmit the changes in tension successively occurring in the strand at the plate level. However, it should be noted that they are a very small amount of the changes in tension occurring in the free shand, that is at the side opposite to anchorage.

The box 20 transmits a large amount of change in tension of the free strand to concrete, essentially biasing to shearing effect the resin with which it is filled up. It should be noted that considerable relative displacements will occur also between the box walls integral with the concrete and strand; therefore no direct contact should arise between the latter and the rigid walls of the box. Should this occur, a particular fatigue phenomenon of the strand, commonly referred to as "fretting corrosion" or fretting fatigue, would be developed.

The resin filling up said tubes 21 will reduce almost to zero the relative movements between the strand and concrete, thus resulting in reduction almost to zero for the change in tension in the strand at the plate level and reduction of the fretting fatigue between said strand and inner wall of the tube.

A second embodiment of the invention is shown in FIG. 6, in which strands 13 are shown as anchored in a per se known manner by devices, generally designated by reference numeral 26, to a load distributing plate 45.

Herein, a strong box 40 of metal material is shown, which has a front flange 41 and a side screw thread 42, on which a ring nut 43 is screwed down, the latter transmitting the strain to said plate 45 which transfers the loads onto the concrete structure 11. Said box 40 has tubes 41 exiting therefrom, but in this case said tubes are incorporated in a separate block 50 of very high strength concrete rather than in said concrete 11.

This embodiment would both provide for adjustment by operating a jack between said flange 41 and plate 45, so as to remove any strain between said ring nut 43 and plate 45, then screwing down said screw nut 43 to the desired position and releasing the jack so that the strain is released through said ring nut 43 onto said plate 45. This structure can also be completely replaced in that, without breaking the concrete 11 of the main casting, the strands 18 can be cut, so that both said box 40 and block 50 along with any thing contained therein can be removed and replaced with other new elements. Of course, all of those variations within the reach of those ordinarily skilled in the art can be made to the foregoing without departing for this from the covering field of this application.

What I claim is:

1. A device for anchoring a plurality of tensioning strands to a structure, which device comprises:

(a) a box encasing intermediate portions of the strands therein;

(b) a plate spaced from the box for securing the free ends of the strands and distributing tension loading;

(c) corrugated sheaths extending from the plate to the box, each sheath encasing a strand, each sheath being filled with epoxy resin for embedding the strand therein and spacing same from adjacent strands, said sheath being embedded in concrete;

(d) the box including a packing of epoxy resin embedding the portions of the strands contained therein and avoiding load peaks in the transition area where strands depart from the box.

2. The device of claim 1 further including means for varying the tension of the strands.

* * * * *